United States Patent [19]

Hurst et al.

[11] Patent Number: 4,528,875

[45] Date of Patent: Jul. 16, 1985

[54] ADJUSTABLE SOCKET

[76] Inventors: Andrew C. S. Hurst; Nicholas J. Hurst, both of 901, Collingwood House, Dolphin Square, London, SW1, England

[21] Appl. No.: 467,942

[22] Filed: Feb. 18, 1983

[30] Foreign Application Priority Data

Feb. 22, 1982 [GB] United Kingdom ..... 8205137
Jun. 23, 1982 [GB] United Kingdom ..... 8218199

[51] Int. Cl.[3] ..... B25B 13/58
[52] U.S. Cl. ..... 81/185; 81/DIG. 11
[58] Field of Search ..... 81/185, 439, DIG. 11

[56] References Cited

U.S. PATENT DOCUMENTS

| | | | |
|---|---|---|---|
| 706,703 | 8/1902 | Tierce | 81/185 X |
| 1,034,383 | 7/1912 | Bronson | 81/185 |
| 1,270,263 | 6/1918 | Burnson | 81/185 X |
| 1,377,758 | 5/1921 | Dobazenecki | 81/185 X |
| 1,600,645 | 9/1926 | Smith | 81/185 X |
| 1,618,715 | 2/1927 | Lammers et al. | 81/185 |
| 1,688,819 | 10/1928 | Leck | 81/185 UX |
| 1,997,948 | 4/1935 | Pearson | 81/185 |
| 2,337,368 | 12/1943 | Bohler | 81/185 |
| 2,711,112 | 6/1955 | Durand | 81/185 |
| 3,127,798 | 4/1964 | Gol | 81/185 X |
| 3,177,910 | 4/1965 | Da Silva | 81/185 X |
| 3,298,261 | 1/1967 | Lynn | 81/185 |
| 3,358,532 | 12/1967 | Allred | 81/185 X |

*Primary Examiner*—James G. Smith
*Attorney, Agent, or Firm*—Lewis H. Eslinger

[57] ABSTRACT

A socket having an interior working part shaped to engage an item such as a nut and having an insert which is geometrically similar to said interior working part of the socket, said insert being a sliding close fit within the socket so as to be movable to and from a position of use and so that one of the socket and said insert can be used to engage said item, and including means to urge said insert towards the position of use, and means for selectively restraining said insert in the position of use.

1 Claim, 11 Drawing Figures

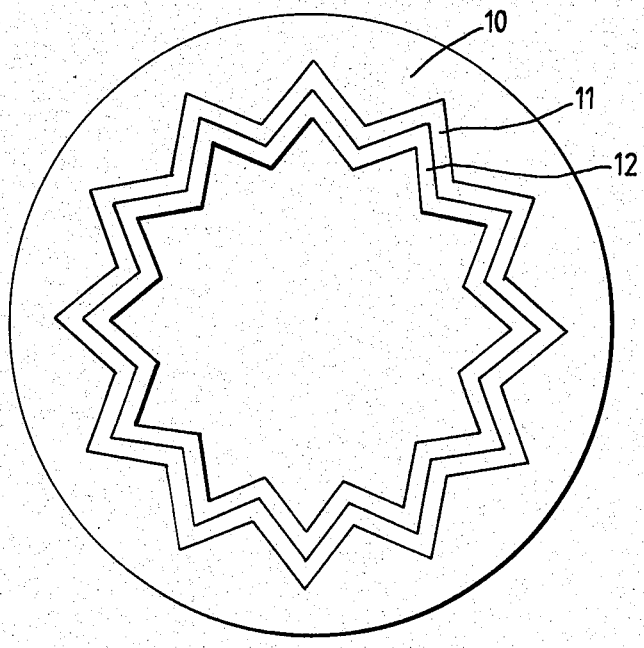
Fig.1.
Fig.4.
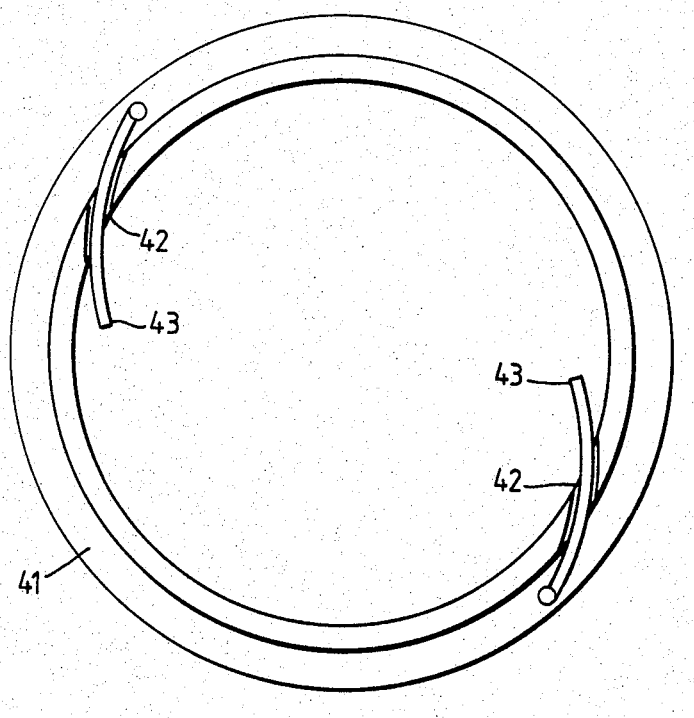

ADJUSTABLE SOCKET

DESCRIPTION

This invention relates to an adjustable socket and more particularly to an adjustable socket such as the socket on a ring spanner which in use entirely or substantially surrounds a nut or the head of a bolt or other threaded fixing member for the purpose of tightening or loosening the same.

Sockets and ring spanners are generally preferred by engineers because they engage a nut or bolt head at the greatest number of points in operation. However, currently used ring spanners and sockets are not adjustable so that an engineer needs a lot of them if he is to feel properly equipped.

There have been proposals to provide a socket, and a spanner having such a socket, which displays the advantages of substantially or entirely surrounding a nut or the like in making multipoint contact therewith while offering some facility for adjustment.

For instance, in British Patent Specifications No. 2,077,644, 1,288,920 and 1,064,836 there is described a socket shaped to engage a nut or the like and having a plurality of inserts geometrically similar to the interior working part of the socket and being a slidable close fit within the socket. Either the socket or one of the inserts can be used to engage the nut, with, according to the nut size, a different number of the inserts pushed out of the way.

It is an aim of this invention to provide an improved socket of this general type.

According to the present invention there is provided a socket shaped to engage a nut or the like and having at least one insert which is geometrically similar to the interior work part of the socket, the insert(s) being a sliding close fit within the socket so as to be movable to and from a position of use and so that either the socket or an insert can be used to engage a nut, and including means to urge the insert(s) towards the position of use, and means for selectively restraining a selected number of inserts in the position of use.

The invention also provides a spanner having such a socket so that a spanner of the invention is a tool having a socket and a handle member extending therefrom to be manually gripped for the purpose of turning the socket. The handle could be for instance integrally fixed, normally though not always generally perpendicular to the axis of the socket, or the handle could be separate from the socket to engage it in use. The socket can be open at both ends or only one as desired and although generally designed completely to surround the member to be turned need not entirely surround it but could instead be open at part of one side. The term "socket" includes for instance the known interchangeable cup shaped sockets normally provided in a set to engage a nut or bolt head and which have projections or shaped parts, which are all the same in the sockets of the set, to be engaged with a manually or mechanically operable tool for the purpose of rotation. Thus the tool may be a ratchet or for instance, an air-driven socket wrench. Although most such sockets are closed at one end and have a driving projection on the closed end this is not essential to the present invention.

With the invention, the socket can offer openings of at least two sizes to receive and fully engage a nut. In the case when there is one such insert the sizes of the opening can be selected depending on whether or not the insert is in an operative position to engage a nut. When engaging the nut each side of the insert acts somewhat like a shim between the socket and nut. In what follows, therefore, the word "shim" is used to mean "insert". With more than one shim the selection is correspondingly increased, being one more than the number of shims. Of course, in the event of more than one shim each is slidably fitting within the next largest. The or each shim can be manually insertable and removable from the socket. Alternatively, all the shims can be kept always within the socket and be slidable therein to and from operating parts of the socket so as to be safely retained within the socket even if they are not in the position of use. In this case means are provided to urge the shims towards the position of use. There are various possibilities for realising this. Firstly, each shim can have a corresponding coil spring acting to urge it toward the operating position. Secondly, a single resilient member can be located in the socket to act on all shims, this for instance being a sponge rubber material such as of neoprene appropriately contoured.

According to the invention, to assist in adjusting the socket to an intermediate size in its range of sizes, and causing only appropriate ones of the shims to be slid out of the operating position without by frictional force also moving others which are required for the operation concerned, means are provided for selectively restraining the or a selected number of the inserts in the position of use. For instance, a mechanical adjusting device can be arranged to provide in effect an adjustable aperture within the socket above the tops of the shims. By a mechanical arrangement it will than be possible to adjust the size of the aperture, for instance stepwise, so that each adjustment removes the impediment on the next shim. The adjustable aperture could be formed by rotatable shaped plate-like members similar to the aperture in a camera or for instance by sliding curved projections which on novement extend to a greater or lesser extent into the interior of the socket. It is appreciated that in use it may be desirable, particularly if a ratchet mechanism is not employed, repeatedly to remove and attach the socket to a nut or bolt head and it is thus contemplated that means can be provided for holding in an inoperative position those shims not required for the operation concerned. For this purpose the socket may be provided with an expandable resilient member which on operation of an external device contracts radially inwardly to engage and thus retain shims which have been moved out of the operating position.

A possible spring arrangement for securing controlled sliding movement of the shims in succession comprises a disc of spring metal having an annular rim and, extending radially inwardly therefrom, sets of fingers each set comprising fingers of different lengths and corresponding to the radii of the shims. As a result the number of fingers acting on the innermost shim will be equal to the number of sets and when all shims are in the operation position each shim outward from the innermost one has fingers acting on it to the number of twice the numbers of sets and so on. Accordingly, in the outward sense each shim is harder to remove than the preceding one and in this way the frictional force can be overcome and the danger of shifting from the operating position more shims than should be shifted is reduced.

In some embodiments a latch arrangement can be provided for maintaining a particular operating configuration of the socket, that is to say a certain number of the shims being kept in an operative position and a certain number being movable or moved to an inoperative position.

In one embodiment the latch arrangement serves to retain those of the shims which are inoperative, i.e. not to engage a nut, and to this end a number of latch arms may be pivoted to the body of the socket and have end portions adapted to engage the inoperative shims. The latching effect can be cancelled and the shims released by squeezing the other ends of the latch arms.

In another embodiment the latch arrangement includes a plate slidably or rotatably attached to a handle of a spanner of which the socket forms a part. This latch can be moved, by rotation or longitudinal movement, so as to overlap a varying number of the movable shims in the socket. A detent mechanism can be provided to hold the latch in the position corresponding to a selected number of shims being restrained in the operative position.

In another embodiment the latch arrangement includes a longitudinal movable pin or plate slidable relative to the handle of a spanner including the socket and movable for instance by a threaded wheel to be turned by the user.

In further embodiments of the invention selective release of shims to move with the socket can be arranged by a threaded member transverse to the socket acting on one end of a pivoted lever the other end of which can move over the tops of the shims to keep them in the operative position. Particular rotational positions of the member will thus correspond to particular numbers of shims being released to move out of the way when a nut is engaged. A slidable bar could be used instead of the threaded member, for instance with a detent to keep it in given longitudinal positions. The bar could project from both sides of the socket, and engage one end of the pivoted lever. Such an embodiment is particularly suitable for a socket to be driven by a ratchetted handle detachably engaging the top of the socket.

In order that the invention may be more clearly understood the following description is given by way of example only with reference to the accompanying drawings in which:

FIG. 1 is an end view of an adjustable socket according to the invention;

FIG. 4 is a diagrammatic view of a first, adjustable, device for releasing shims for sliding movement;

Shown in FIG. 1 in an end view at 10 is a socket having twelve teeth with recesses between them such as is commonly used to engage a nut or a bolt head. At 11 is shown a first shim which has an exterior surface matching the interior surfaces of the teeth of the socket 10 and has a constant thickness so that its interior surface is geometrically similar to the teeth of the socket but of smaller size. In this example there is a second shim 12 in similar relation to the first shim 11. This embodiment thus gives three possible effective socket sizes.

Figure 2:
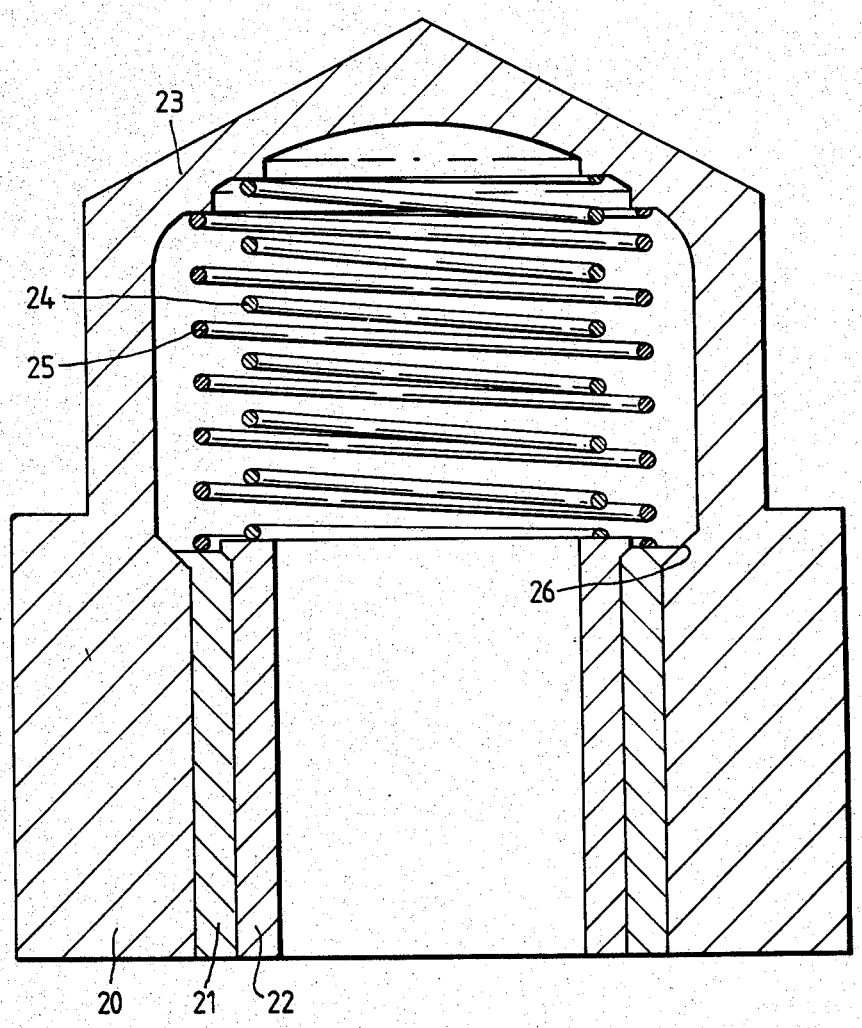
FIG. 2 is a longitudinal sectional view of an adjustable socket according to the invention.

A similar arrangement is shown in longitudinal section in FIG. 2 where a main part of the socket is shown at 20, this having again two shims 21 and 22 being a matching sliding fit respectively in the socket and in the first shim. The other part of the socket comprises a closed housing 23 into which one or both of the shims 22 and 21 can be slid against the action of respective springs 24 and 25. It will be seen that adjacent its upper end each shim is slightly widened so that shim 21 has a lip bearing on a ledge 26 of the socket, and the shim 22 likewise bears on the shim 21. This means that the shims cannot fall out of the socket although they are free to slide into the housing part 23.

Figure 3:
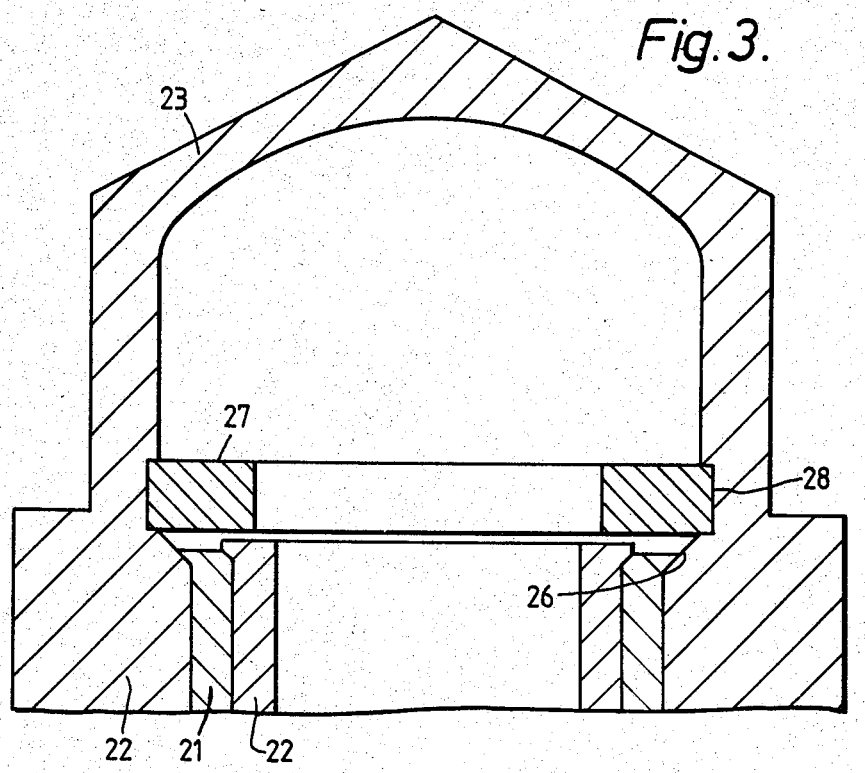
FIG. 3 is a partial longitudinal sectional view showing a modification of the embodiment of FIG. 2.

A modification of this arrangement is shown in FIG. 3, like references being used to indicate like parts, but instead of the springs 24 and 25 there is here provided a resilient annular ring 27 of width such that it is located above the tops of the two shims. The ring is held in a groove 28 in the housing part 23. Suitable material is neoprene rubber and it will be understood that the resilient ring can initially be deformed by the inner shim 22, allowing the shim to slide up into the housing 23 while still acting downwardly on the other shim 21. If shim 21 also is to be displaced then the ring can be further deformed to allow this.

In all embodiments it may be advantageous to provide lubricating channels on the or selected exterior faces of the annular shims and where a sponge rubber resilient member is used, as suggested in FIG. 3, this can also function as a reservoir for lubricant.

In use if a socket is placed coaxially upon a nut or bolt head and pressed thereagainst it might be expected that the number of shims which have to be moved out of the way for a correct engagement will be automatically so moved as the socket is pressed onto the nut. In practice, however, frictional forces would tend to shift more shims than should be moved in the absence of the restraining means of the invention. One such means is shown only schematically in FIG. 4 in which shows a wall of the socket generally above the teeth and recesses therein and 41 represents a ring rotatably mounted therearound. Pivotally mounted on the ring 41, and extending through holes 42 in the part 40, are two fingers 43. It will be seen that upon rotation of the ring 41 the relative arrangement of the pivots and holes 42 for the fingers will cause these to extend to different radial extents inwardly of the socket. Accordingly with such an arrangement when the socket is placed upon a nut and pressed thereagainst, the ring 41 could be rotated successively to allow shims to be moved upwards for instance into a housing as shown at 23 in the preceding Figs. When as a result of movement of the shims the socket achieves the correct size it will move over the nut and engage therewith.

Figure 5:
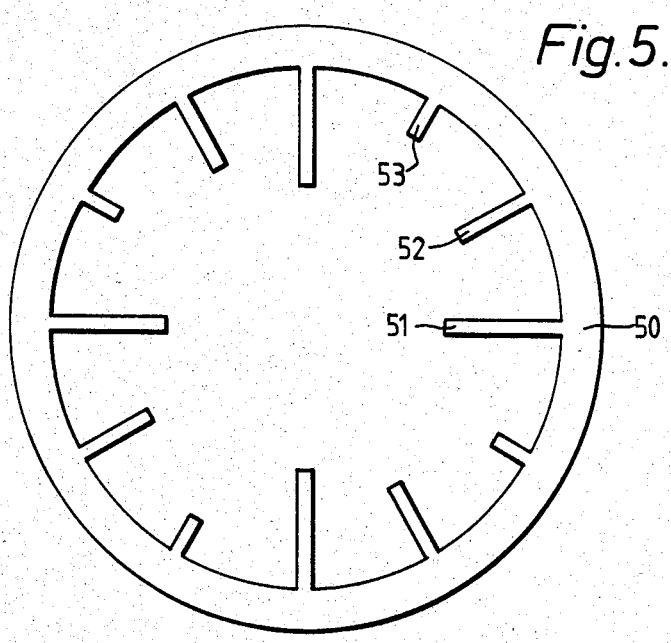
FIG. 5 is a schematic view of a second device for the same purpose.

FIG. 5 shows an alternative arrangement for selectively releasing the shims for sliding movement, this comprising a ring 50 to be located in a socket and from which extend radially inwards four sets each of three fingers 51, 52 and 53, each of the three fingers being of different lengths and respectively adapted to overlie three, two or one slidable shim. The embodiment as illustrated in FIG. 5 is adapted for use with three shims and it will readily be understood that all the fingers act on the outermost shim, eight of the fingers act on the middle one and only four of the fingers act on the most inwards one. Accordingly when applying a socket against a nut as previously described the resistance to sliding movement of the shims increases with their location in the radially outward sense. The difference in restraining force on each shim can be arranged to overcome the likely friction between shims and thus ensure that only those which must be moved are moved.

Desirably the shims can be made of hardened steel, as mentioned they may have lubricating channels in them or they may have a coating of polytetrafluorethylene to assist relative sliding.

Insofar as the operation of tightening or loosening a nut or the like may require the socket to be removed from time to time, particularly if there is no ratchet mechanism, a preferred feature of the invention will allow the adjustable socket to remain set in a particular position with a particular number of the shims slid out of the operating position. Various means are contemplated for this purpose, for instance a resilient annular nember which when a required setting is reached can be compressed axially so that it contracts radially inwardly to engage the or the outermost of the shims which have been slid from the operating position. If more than one shim is so slid then for instance by reason of the lips shown clearly in the FIG. 2 embodiment that outermost shim will hold the others out of the operating position.

The socket can be of unitary construction or two part construction with the parts welded or otherwise securely fixed together, the two parts for instance corresponding to the parts 20 and 23 of FIG. 2. The latter possibility may be particularly useful when a resilient pad such as 27 of FIG. 3 or disc such as 50 of FIG. 5 can be held between the two parts. The exterior of the socket can, of course, be provided with shapings or projections allowing it to be engaged by a handle or ratchet mechanism.

In an alteration to the FIG. 4 embodiment the fingers 43, whether there is only one or more of them, can be pivoted on the socket 40 and have a sliding engagement with the surrounding rotatable ring. This may allow the radial component of their movement to be more precise.

Figure 6:
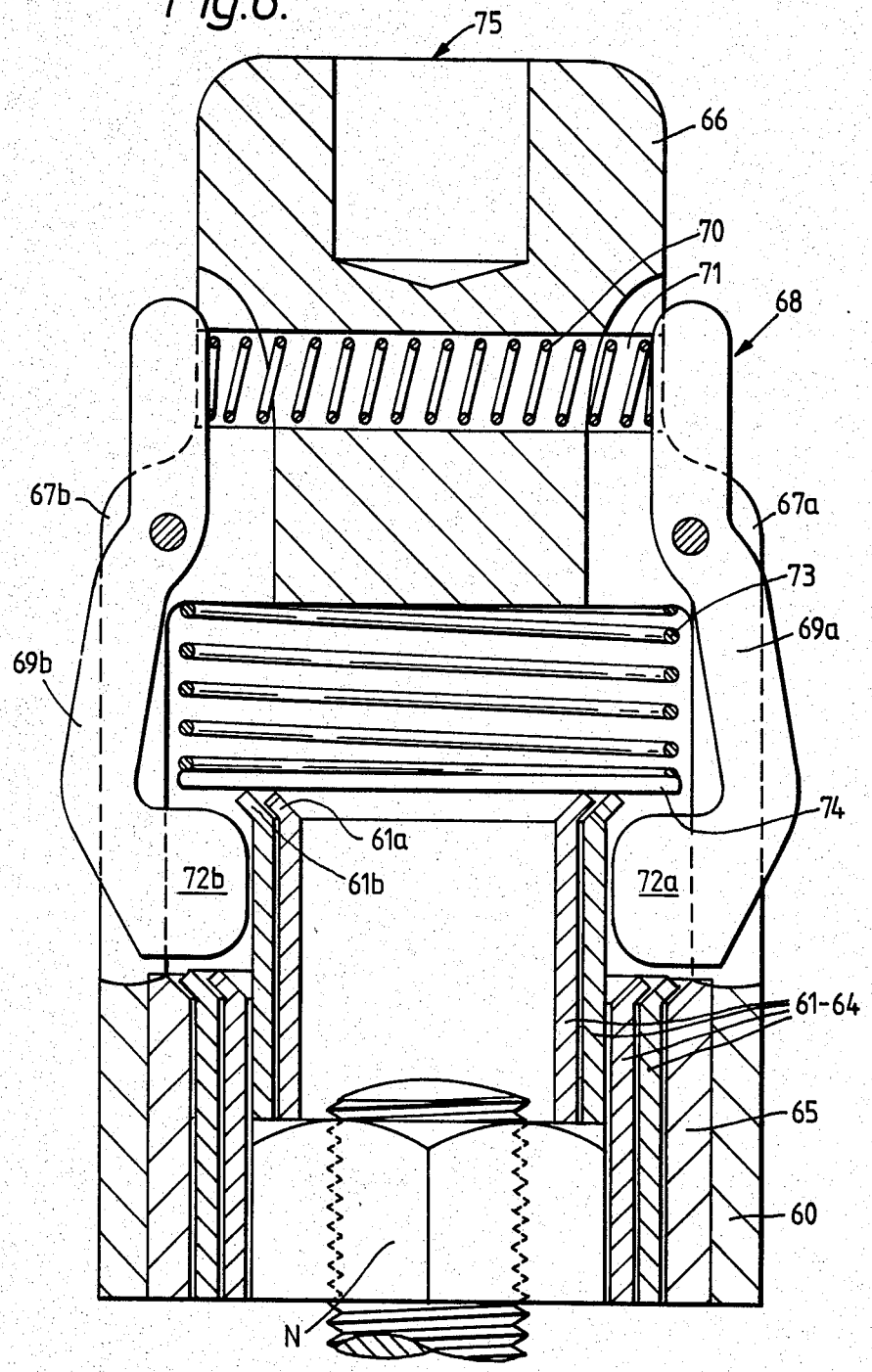
FIG. 6 is a sectional view of a further embodiment.

FIG. 6 shows an embodiment in which four geometrically similar shims 61 to 64 are slidably mounted within a retaining ring 65 whose inner periphery also conforms with the outer periphery of the outermost shim 64. This ring 65 is heat shrunk into an annular member 60 which is in turn connected to a drive head 66 by means of a number of longitudinally extending arms 67*a*, 67*b* symmetrically disposed around the axis of the socket. In this arrangement those shims which have been pushed to their retracted positions for instance by the socket being pushed onto a nut N which the socket is to turn are retained there by means of a latch arrangement 68 which suitably comprises two or more latch arms such as 69*a*, 69*b*. These arms are pivoted to respective ones of the arms 67*a*, 67*b* to pivot about axes which are perpendicular to the axis of the socket and are tangent to a circle centered on the axis of the socket. The upper ends of the latch arms are resiliently bulged outwards by suitable means. In the case of there being two latch arms this can be achieved by the upper ends being engaged by the two ends of a compressed coil spring 70 extending through a bore 71 in the lower end of the drive head 66. The other ends of the latch arms have inwardly directed portions 72*a*, 72*b* which latch under flared portions 61*a*, 61*b* provided on the upper ends of the shims 61 to 64 when one or more of the shims is pushed to its inner position. Thus the shim 61 or shims 61, 62 or shims 61 to 63 or all four shims may be retained as necessary by the latches. Once retained they can of course be released simply by pressing on the upper ends of the latch arms whereupon a coil spring 73 which acts via a pressure plate 74 will push the shims back to their outer positions. The pressure plate 74 is wider than the widest of the shims, that is shim 64. As the shims are pushed up they themselves deflect the arms and pass beyond the portions 72*a*, 72*b*.

The drive head 66 may be provided with any suitable drive means, the example in FIG. 1 being a square section bore 75 to correlate a square section drive bar or ratchet.

Figure 7:
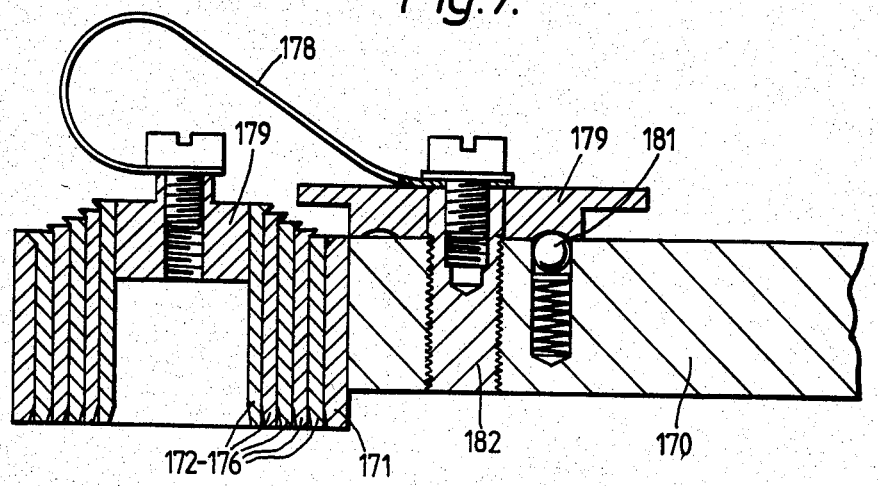
FIG. 7 is a sectional view of a further embodiment.
Figure 8:
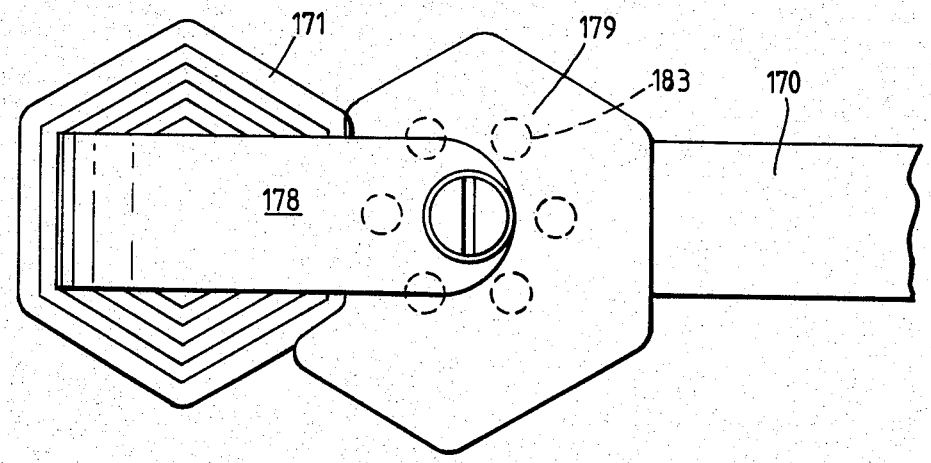
FIG. 8 is a top plan view of the embodiment shown in FIG. 7.

Shown in FIGS. 7 and 8 is a spanner according to the invention having a handle 170 attached to a ring socket 171. Axially movable within the socket 171 are five geometrically similar shims 172 to 176, each having a slightly out-turned upper end to overlie the next largest one. Within the innermost shim 176 at its top there is a block 177 to which is screw threadedly attached one end of a metal spring 178 which is looped to urge all the shims axially downwardly as shown in the Figures. The other end of the spring 178 is attached to the handle on the line of rotation of a rotatable latch 178 which is movable between six different positions in each of which it can be retained by a spring urged ball detent 181 mounted in the handle. The latch 179 has six sides each a different radial distance from its axis of rotation, it being pivoted on a pin 182 mounted in the handle. It has a corresponding recess 183 for each side when the ball 181 is received in the associated recess when the diametrically opposite side of the latch overlies and is aligned with one side of the shims. It will readily be understood that in accordance with the rotational position adopted for the latch so any number-from none to five of the shims is free to move axially upwards relative to the ring 171 and accordingly there are six possible nut sizes which can be engaged by this particular embodiment of spanner with a socket of the invention.

This embodiment is exceedingly easy to use because while the user holds the handle 170 he can operate the latch 179 with his thumb and thus the adjustment of the spanner can be performed one handed. The looped spring is necessary to stop the shims from falling out, while accommodating upward movement, particularly when the spanner is used on a downward facing nut and also ensures that the spanner can be more readily matched to a particular nut size. It is conceivable for different sets of shims to be provided for one spanner and from the simplicity of construction it will be appreciated that it is easy to remove one set and replace it with another. For instance sets for imperial and metric size nuts may be provided. As shown the shims will offer six point engagement but alternatively twelve point engagement can be arranged.

Figure 9:
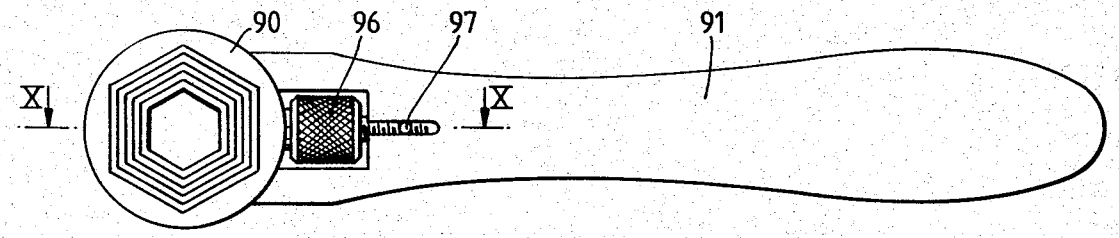
FIG. 9 is a sectional view of a further embodiment of the invention.
Figure 10:
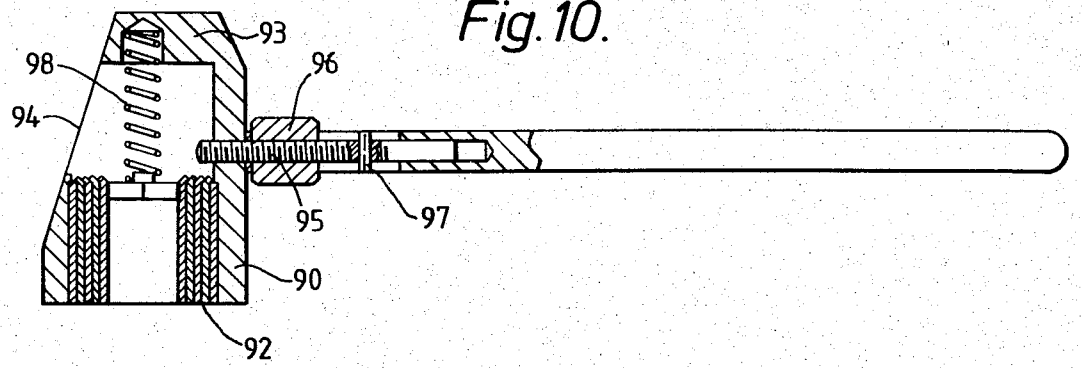
FIG. 10 is a top plan view of the embodiment shown in FIG. 9.

FIGS. 9 and 10 show another embodiment of spanner according to the invention, comprising a ring 90 attached to one end of a handle 91 and having therein a number of hexagonal shims indicated generally at 92 which are geometrically similar to the interior socket in the ring 90. The ring 90 extends upwardly to define a housing having a closed end 93. As shown the housing has an aperture 94 at one side in an inclined face. This allows ease of assembly and inspection of the movement of the shims by the user. A compression spring 98 is located between the top of the housing at 93, where it is received in a blind bore, and the innermost of the shims 92.

A feature of this embodiment is the slidable selector which comprises a threaded bolt 95 extending longitudinally of the handle 91 through a hole into the interior of the housing above the shims. Mounted on this bolt is a nut 96 and the bolt is prevented from rotating by a transverse pin 97 movable in a slot in the handle. Rotation of the nut 96 therefore causes the bolt to move inwards and outwards of the housing. The bolt has a rounded end within the housing so that it can ride conveniently over the shims. The embodiment not only allows certain shims to be retained in the operating position, but can also allow shims to be engaged from the side by the bolt and in this way be held in the inoperative position which is useful when the spanner needs to be removed from the nut between turns.

The height of the housing can be reduced in an alternative not illustrated arrangement where a spiral spring is used in place of the illustrated compression spring 98. The pin 97 may be movable alongside markers on the handle so as to indicate particular positions of the bolt 95 which correspond to the retention in the operating position of certain of the shims 92. As an alternative, the thread on the bolt and nut can be so selected that a single revolution of the nut 96 causes the bolt 95 to move by a distance corresponding to the thickness of a shim so that each revolution of the nut will correspond to one more or less shims being restrained in the operating position. The nut 96 could have a detent arrangement to hold it in angular positions corresponding to particular numbers of shims. The use of an externally threaded nut engaging with a slidable bolt is also possible. A further possibility is a knurled wheel with its axis of rotation transverse to the longitudinal direction of the handle. Such a wheel can be provided with a cog or toothed wheel at one end, the cog being engageable with ratchet teeth on a slidable plate. If the teeth on one or both of the wheel or plate are spring teeth, lost motion can occur when resistance is met, and this will allow the pin to be most easily inserted into the housing to engage and retain in the inoperative position such shims as may have been pushed up so as to be inoperative.

It is generally found that six-sided shims are more appropriate than twelve-sided for the purposes of the present invention, particularly in the versatility provided with regard to engaging nuts of different size systems.

However, it is possible to provide alternative sets of shims for instance for imperial and metric sizes and in such a case the housing can be made detachable into upper and lower parts for instance threaded together, so that ready replacement of the sets of shims can be brought about.

Sockets similar to those shown in FIGS. 9 and 10 can be employed without a handle, for instance to be driven in the usual way via a recess in the top. In such a case, of course, the longitudinally movable bolt will be inappropriate and it will be better to employ a ring type adjustment on the exterior of the housing such as shown in FIG. 4 and discussed in connection with that Figure.

Figure 11:
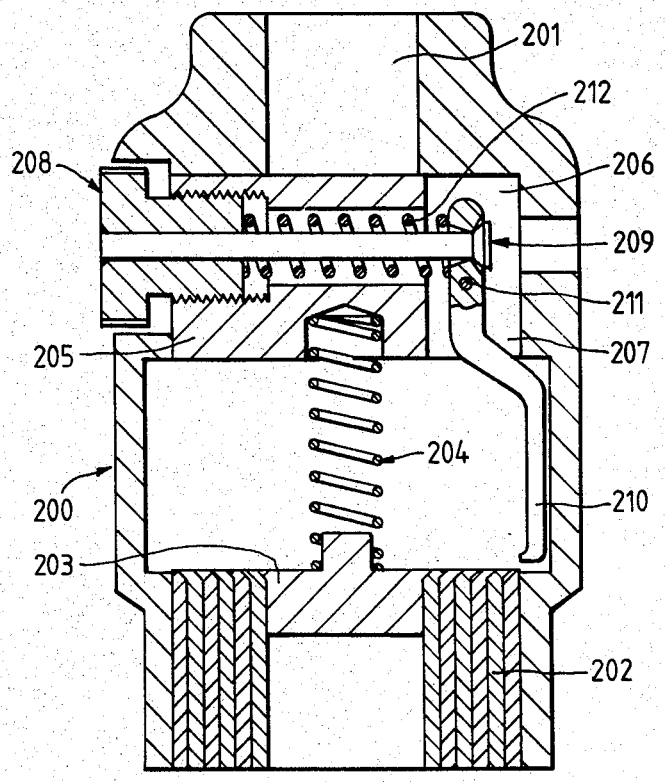
FIG. 11 is a sectional view of a further embodiment of socket according to the invention.

FIG. 11 is a sectional view of a socket 200 according to the invention which has a standard sized square recess 201 at the top to receive the driving projection of an interchangeable handle which preferably includes a ratchet. Slidably located in the bottom of the socket are six shims 202 similar to those already described, with out-turned upper edges within the body of the socket. The innermost shim is attached to a block 203 on which acts a compression spring 204 engaging at its upper end in a socket in the upper wall 205 of the interior of the socket. In that upper wall 205, which separates the interior of the socket from the square recess 201, there is a transverse bore 206 leading to a passage 207 parallel to the socket axis. The bore 206 is of enlarged radius at its end remote from the passage 207, and in this part there is screw threadedly mounted an adjusting head 208. Rotation of the head therefore moves it in and out of the bore. Attached to the head 208 is a shaft 209 extending through the bore 206 and ending at the end of the passage 207. The shaft 209 passes through one end of a lever 210 which is pivoted at 211. A spring 212 urges the end of the lever 210 to the right as shown against an enlarged end of the shaft 209.

It will readily be appreciated that upon turning the head 208 the shaft 209 moves in and out, taking with it one end of the lever 210. The other end of the lever moves, therefore, over a greater or lesser number of the shims 202. The head 208 can have a transverse projection which is readily manually engaged for turning purposes. Preferably the outer wall of the socket near the head is marked to indicate rotational positions which correspond to the lever 210 being in positions to prevent certain numbers of shims 202 from being displaced. In this way, the user merely has to "dial" the aperture size he requires, say on a marked range of 0–6, and the selected number of 0–6 shims will be free to move up into the interior of the socket. The bolt can be case hardened, preferably having a fine thread. It would be possible and advantageous to provide a spring urged ball detent mechanism for instance on the head 208 to engage recesses at positions corresponding to the possible sizes provided by the socket and shims.

This socket could be modified by having the shaft 209 and the spring 212 act on the lever 210 on opposite sides of its pivot point. In this case, the shaft would press on the lever from the left as shown and the spring, provided in an additional transverse bore in the upper wall 205, would act in the same direction. The head could include a spring and ball or like detent in a transverse bore to engage recesses and provide a restraint against rotational movement from particular positions.

A modification available to the spanner of FIGS. 9 and 10 is to provide a worm gear rotatably mounted above the handle 91 on a shaft, such gear engaging teeth on a sliding selector extending from the handle to a varying extent into the head. This may provide more secure positioning of the selector.

We claim:

1. A socket having an interior working part shaped to engage an item such as a nut and having a first insert which is geometrically similar to said interior working part, said first insert being a sliding close fit within the socket so as to be movable to and from a position of use, at least one second insert in like relation to said first insert as said first insert is to said working part, so that one of the socket and the first insert and the second insert can be used to engage said item, and including means to urge said inserts towards the position of use and means for selectively retaining said inserts in said position of use, said means for selectively retaining including at least one lever pivoted within the socket about an axis transverse to the axis of the socket, such that one end is movable to retain selected numbers of inserts in the operating position, and including means acting on the other end of the lever to control movement thereof, said means acting on the other end of the lever including a threaded member extending transverse to the socket and longitudinally movable upon rotation to cause the lever to pivot.

* * * * *